US007296705B2

(12) United States Patent
Boulet-Mazer

(10) Patent No.: US 7,296,705 B2
(45) Date of Patent: Nov. 20, 2007

(54) DISPENSING SYSTEM AND ASSEMBLY HAVING A SHELF INTEGRATED WITH ONE OR MORE COMPARTMENTS FOR DISPENSING FLEXIBLE ARTICLES

(75) Inventor: Renee Marie Boulet-Mazer, Thornton, CO (US)

(73) Assignee: Amazer, Inc., Thornton, CO (US)

( * ) Notice: Subject to any disclaimer, the term of this patent is extended or adjusted under 35 U.S.C. 154(b) by 0 days.

(21) Appl. No.: 11/202,773

(22) Filed: Aug. 12, 2005

(65) Prior Publication Data

US 2006/0091146 A1 May 4, 2006

Related U.S. Application Data

(60) Provisional application No. 60/615,795, filed on Nov. 1, 2004, provisional application No. 60/662,848, filed on Mar. 17, 2005.

(51) Int. Cl.
*A47K 10/24* (2006.01)
*B65H 1/00* (2006.01)

(52) U.S. Cl. ..... 221/46; 221/45; 221/61; 221/34

(58) Field of Classification Search ..... 221/61, 221/62, 45, 34
See application file for complete search history.

(56) References Cited

U.S. PATENT DOCUMENTS 1,569,459 A 1/1926 Colbert et al.
2,411,310 A * 11/1946 Wilkins ..... 221/34
2,738,898 A * 3/1956 Lee ..... 221/35
2,840,268 A 6/1958 Casey et al.
2,976,096 A 3/1961 Rueckert
3,632,017 A 1/1972 Matthews
3,642,336 A 2/1972 Harvey, Sr.
D267,842 S 2/1983 Brescia et al.
4,411,374 A 10/1983 Hotchkiss
D272,059 S 1/1984 Bell et al.
4,429,638 A 2/1984 Licari (Continued)

FOREIGN PATENT DOCUMENTS

JP 58-30845 2/1983

(Continued)

OTHER PUBLICATIONS

Bathroom Mirror Cabinet by Pottery Barn published prior to Apr. 12, 2005.
Framed Mirror by Pottery Barn published prior to Apr. 12, 2005.
Healthy Shelf Inc. Advertisement written by Healthy Shelf Inc. published Mar. 2005.

(Continued)

*Primary Examiner*—Gene O. Crawford
*Assistant Examiner*—Timothy Waggoner
(74) *Attorney, Agent, or Firm*—Bell, Boyd & Lloyd, LLP

(57) ABSTRACT

An assembly useable in conjunction with a plurality of flexible articles. The assembly includes at least one compartment configured to hold a plurality of the flexible articles. The compartment defines an outlet configured to enable the flexible articles to be removed from the compartment through the outlet at least one at a time. The assembly includes at least one mount connected to the housing and a door. The door has a shelf surface. The assembly provides users with increased shelving and storage space, access to flexible articles, and convenience of use.

21 Claims, 17 Drawing Sheets

U.S. PATENT DOCUMENTS

| | | | | |
|---|---|---|---|---|
| 4,444,355 | A * | 4/1984 | Cary | 220/908 |
| D275,631 | S | 9/1984 | Licari | |
| 4,553,275 | A | 11/1985 | Goldstein | |
| 5,623,880 | A * | 4/1997 | Kuntz | 242/598.1 |
| 5,957,325 | A * | 9/1999 | Montanez | 221/131 |
| D424,851 | S | 5/2000 | Smith et al. | |
| 6,346,153 | B1 | 2/2002 | Lake et al. | |
| 6,672,474 | B2 * | 1/2004 | May et al. | 221/34 |
| 2003/0042828 | A1 | 3/2003 | Bonin | |

FOREIGN PATENT DOCUMENTS

| | | |
|---|---|---|
| JP | 5-123225 | 5/1993 |

OTHER PUBLICATIONS

"Wall Mount Paper Towel Holder," Shop.com, 2 pgs., [online] [printed from the Internet Apr. 6, 2005] <http://amos.shop.com/amos/cc/main/ccn_search/st/bathroom%20shelf%20paper%20towel/sy/productsx/ccsyn/260/prd/13738684/ccsid/360508352-1945/adtg/04050523>.

"Surface Mounted Toilet Tissue Dispenser with Shelf," SuiteSupply.com, 2 pgs., [online] [printed from the Internet Apr. 6, 2005] <http:www.suitesupply.com/Surface-mounted-Toliet-Tissue-Dispenser-with-Shelf.B2840.01.htm>.

* cited by examiner

DISPENSING SYSTEM AND ASSEMBLY HAVING A SHELF INTEGRATED WITH ONE OR MORE COMPARTMENTS FOR DISPENSING FLEXIBLE ARTICLES

PRIORITY CLAIM

This application is a non-provisional of and claims priority to and the benefit of U.S. patent application Ser. No. 60/615,795, filed Nov. 1, 2004 and U.S. patent application Ser. No. 60/662,848, filed Mar. 17, 2005, the entire contents and disclosures of which are hereby incorporated.

BACKGROUND OF THE INVENTION

Many households and businesses provide disposable paper towels in restrooms, kitchens and other areas. A variety of different types, shapes and sizes of helpful paper towels have been developed, including, without limitation, stacked or rolled towels, boxed or rolled tissue, and different types of stacked and canisterized wet wipes for cleansing, disinfecting, dusting, polishing, shining and other purposes. In addition, many households and businesses store several items in the same rooms where they provide the paper towels. These items include cleansing products, deodorizers, plants, pictures and art pieces, among other articles. For these reasons, there is a growing need to facilitate the accessibility and use of these paper towels, and there is also a growing need to facilitate the shelving of items in the areas where these paper towels are located.

SUMMARY OF THE INVENTION

The dispensing system and assembly, in one embodiment, includes a disposable towel dispenser integrated with a shelf. The dispenser includes multiple compartments for different types of disposable towels. For example, one compartment is configured to dispense dry paper towels through a bottom chute, and another compartment is configured to dispense wet wipes or wet towels through a side chute. The dispensing system and assembly has hanging mounts which enable users to conveniently hang the assembly on their bathroom, kitchen and other walls. Such convenience facilitates the use of disposable towels in households and businesses. The use of disposable towels, instead of cloth towels, can reduce the spread of illness caused from the sharing of contaminated cloth towels. In addition, the use of wet wipes or wet towels, some of which can include antibacterial solutions, can decrease the spread of cold viruses and other diseases. In operation, a user can install or load disposable towels into the dispensing assembly by removing the lid. After loading the dispensing assembly with disposable towels and closing the lid, users can shelve various items on the dispensing assembly for decoration or utility purposes, providing increased counter space. In addition to shelving their items on the dispensing assembly shelf, users can conveniently withdraw towels or wipes from the dispensing assembly with one hand.

Additional features and advantages of the present invention are described in, and will be apparent from, the following Detailed Description of the Invention and the figures.

DETAILED DESCRIPTION OF THE INVENTION

Figure 1:
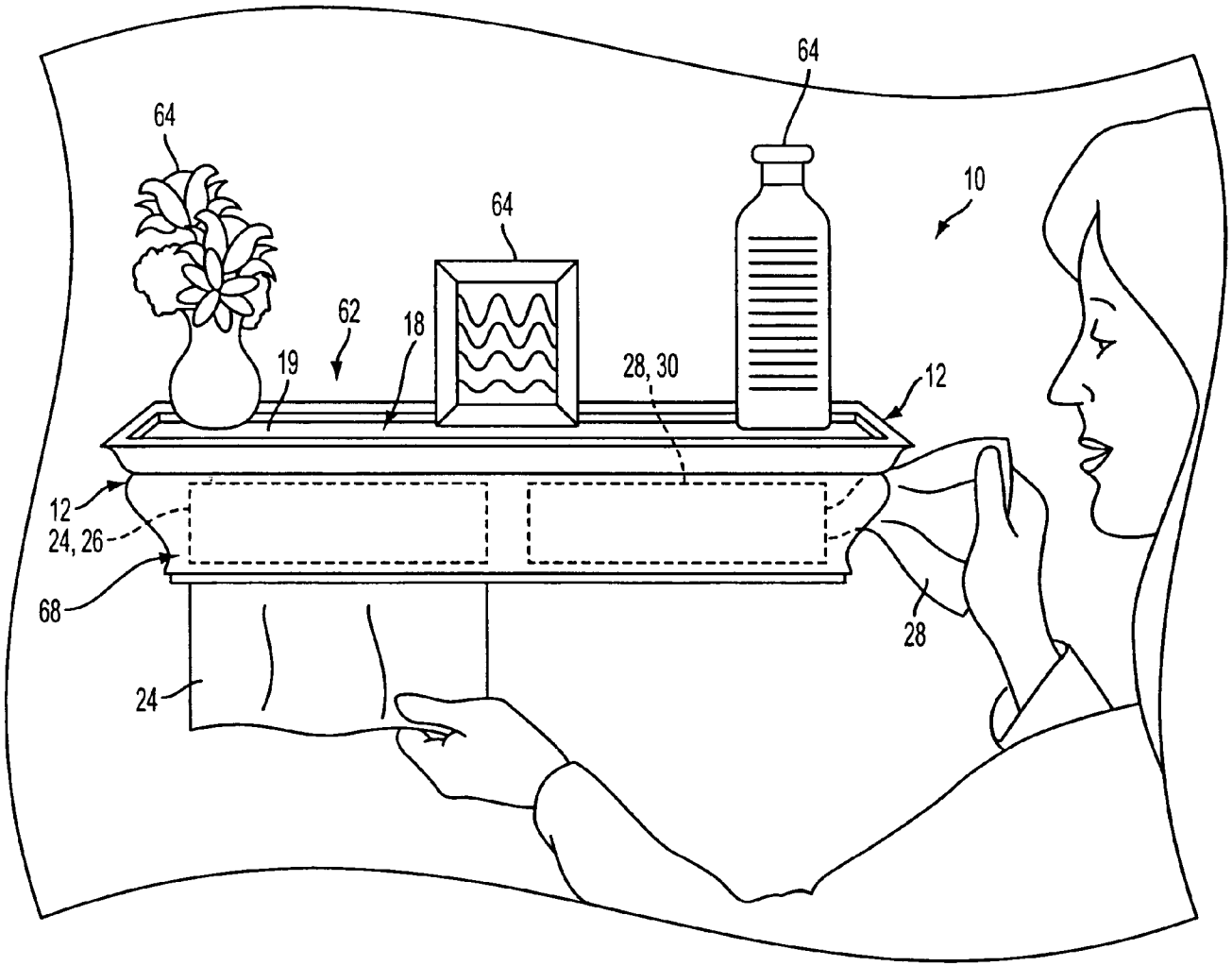
FIG. 1 is a perspective view of one embodiment of the multi-compartment dispensing assembly, illustrating an example of a user withdrawing a dry paper towel from the left compartment and a wet paper towel from the right compartment.
Figure 2:
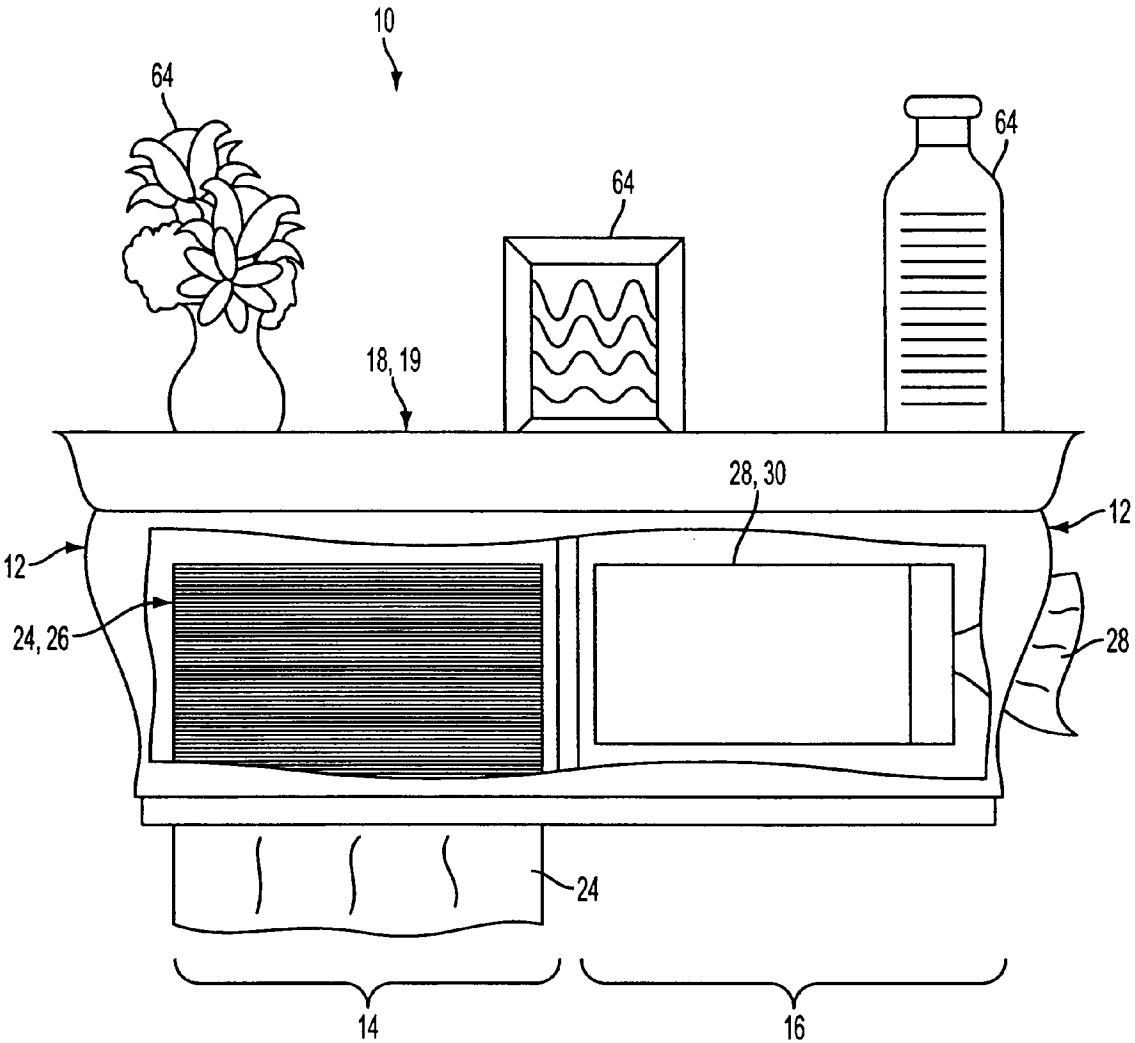
FIG. 2 is a front elevation view of the assembly of FIG. 1, showing a break-away of a portion of the front wall illustrating the interior of the compartments of the assembly.
Figure 3:
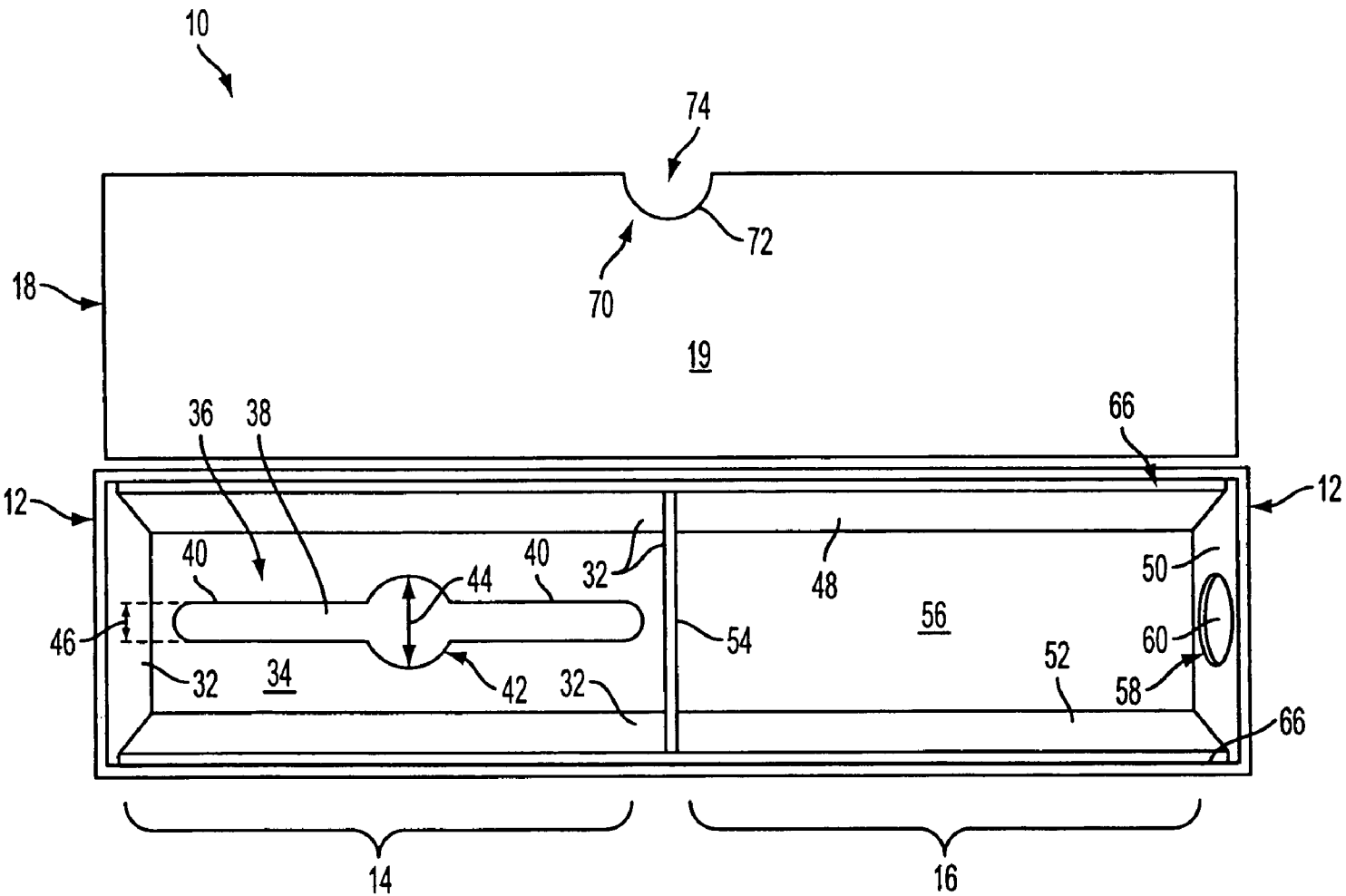
FIG. 3 is a top perspective view of the assembly of FIG. 1, illustrating the shelf surface of the door in an open position, removed from the housing.

The dispensing system and assembly can be used in conjunction with any suitable type of disposable towel, including, without limitation, a flexible sheet, wipe, tissue, napkin or any other suitable disposable flexible article, whether assembled in rolls, stacks or other configurations and whether constructed of paper, polymer or any other suitable material. In one embodiment, such disposable towel includes a liquid, lubricant, cleanser, polish, disinfectant, medication, perfume, fragrance or other chemical added to the towel during the manufacture, assembly or packaging of the towel.

I. Multi-Compartment Assemblies

Referring to FIGS. 1-4, in one embodiment the multi-compartment dispensing assembly 10 includes: (a) a housing 12 which includes a bottom dispensing compartment 14 and a side dispensing compartment 16; (b) a door 18 which covers part or all of the compartments 14 and 16 when closed; and (c) a plurality of picture-type hang mounts, hangers or hang mounts 20 connected to the rear wall 22 of the housing 12.

The bottom dispensing compartment 14 holds a plurality of disposable towels 24 or a disposable towel unit 26. Likewise, the side dispensing compartment 16 holds a plurality of disposable towels 28 or a disposable towel unit 30. The bottom dispensing compartment 14 includes a plurality of retaining walls 32 connected to a bottom wall 34. The bottom wall 34 includes an outlet wall 36 which defines a chute or outlet 38. In one embodiment, the outlet wall 36 has an elongated slot shape including a plurality of side portions 40 and a central portion 42. Each side portion 40 has a rounded rectangular configuration, and the central portion 42 has a partially circular or circular configuration. The width 44 of the central portion 42 is greater than the width 46 of each of the side portions 40. This assists users in accessing the paper towels 24 to pull a paper towel 24 through the outlet 38. For example, the width 44 can be sized to enable a user to insert a portion of his or her fingers through the outlet 38 to reach a paper towel 24. It should be appreciated that the outlet 38 can include a configuration of variable widths, and the portion with the greater width can be located at any suitable location along the outlet wall 36.

The side dispensing compartment 16 includes a plurality of retaining walls 48, 50, 52 and 54, and the side dispensing compartment 16 includes a bottom wall 56. The retaining wall 50 includes an outlet wall 58 which defines a side outlet 60. The side outlet 60 is illustrated as having a circular configuration, though it should be understood that the side outlet 60 can have any suitable configuration.

The door 18 has a substantially flat or a flat configuration as illustrated in FIGS. 1-4. As such, when the door 18 is in the closed position 62, as illustrated in FIG. 1, the door 18 functions a shelf or shelving surface. Accordingly, the door 18 has a shelf surface 19. This enable users to store or rest a plurality of shelvable items 64 on the multi-compartment dispensing assembly 10. In the example illustrated in FIGS. 1-4, the door 18 is configured to fit within the perimeter recess 66 defined by the exterior housing walls 68 and the retaining walls 32, 48, 50, 52 and 54. Accordingly, in this example, the door 18 has no hinges or connectors which would mechanically couple the door 18 to the housing 12. Put another way, the door 18 is hingelessly carried by the housing 12 in a slot-groove configuration. As such, the user can insert the door 18 into the perimeter recess 66 to close the door 18, and the user can open the door 18 by removing the door 18 from the perimeter recess 66. In the example illustrated, the door 18 has a door grasp member 70 which assists users in grasping the door 18. In this example, the door grasp member 70 includes a grasp wall 72 which defines a void or recess. 74. When the door 18 is in the closed position 62, the user can insert his or her fingers through the recess 74, apply a force to the underside of the door 14 and remove the door 14 from the housing 12. It should be appreciated that the grasp wall 72 can define any suitable void including, but not limited to, an opening, slot, cut-away or irregularity. In addition, the door 18 can include any suitable member or device which assists users in grasping or handling the door 18 including, but not limited to, a knob, stud, ridge, raised portion or irregularity.

Figure 4:
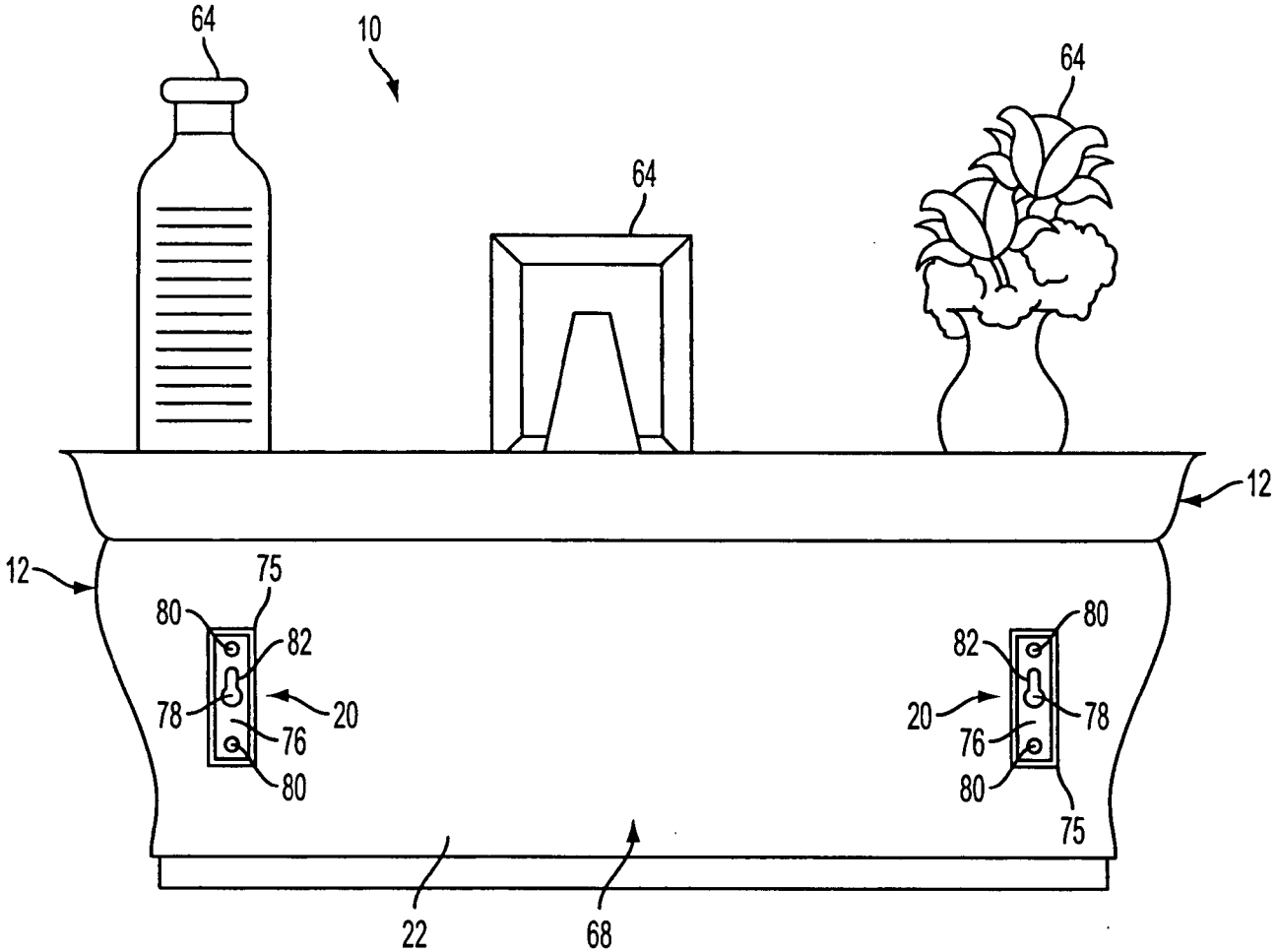
FIG. 4 is a rear elevation view of the assembly of FIG. 1, illustrating the hang mounts.

Referring to FIG. 4, the hang mounts 20 enable users to hang the assembly 10 on a building or room wall (not shown) without having to access the compartments 14 and 16. In the example illustrated, the hang mounts 20 each include: (a) a wall or plate 76 which defines a fastener head opening 78; and (b) a plurality of fasteners 80 which couple the plate 76 to the rear wall 22. The rear wall 22 defines a plurality of mount cavities or recesses 75, each of which is sized to receive the plate 76. The configuration of the plates 76 and the recesses 76 define a space (not shown) which enables the heads of fasteners to be located underneath the plates 76. To hang the assembly 10 on a wall, the user can screw two screw fasteners into a wall with the heads of the screws protruding from the wall. Next, the user aligns the head openings 78 with the heads of the screws and slides the screws into the slots 82. Since the slots 82 are smaller than the head openings 78, the heads of the screws are locked in place, and the assembly 10 is mounted to the wall. With this function of the hang mounts 20, the assembly 10 is a hang-able assembly 10, providing additional convenience to users.

Figure 5:
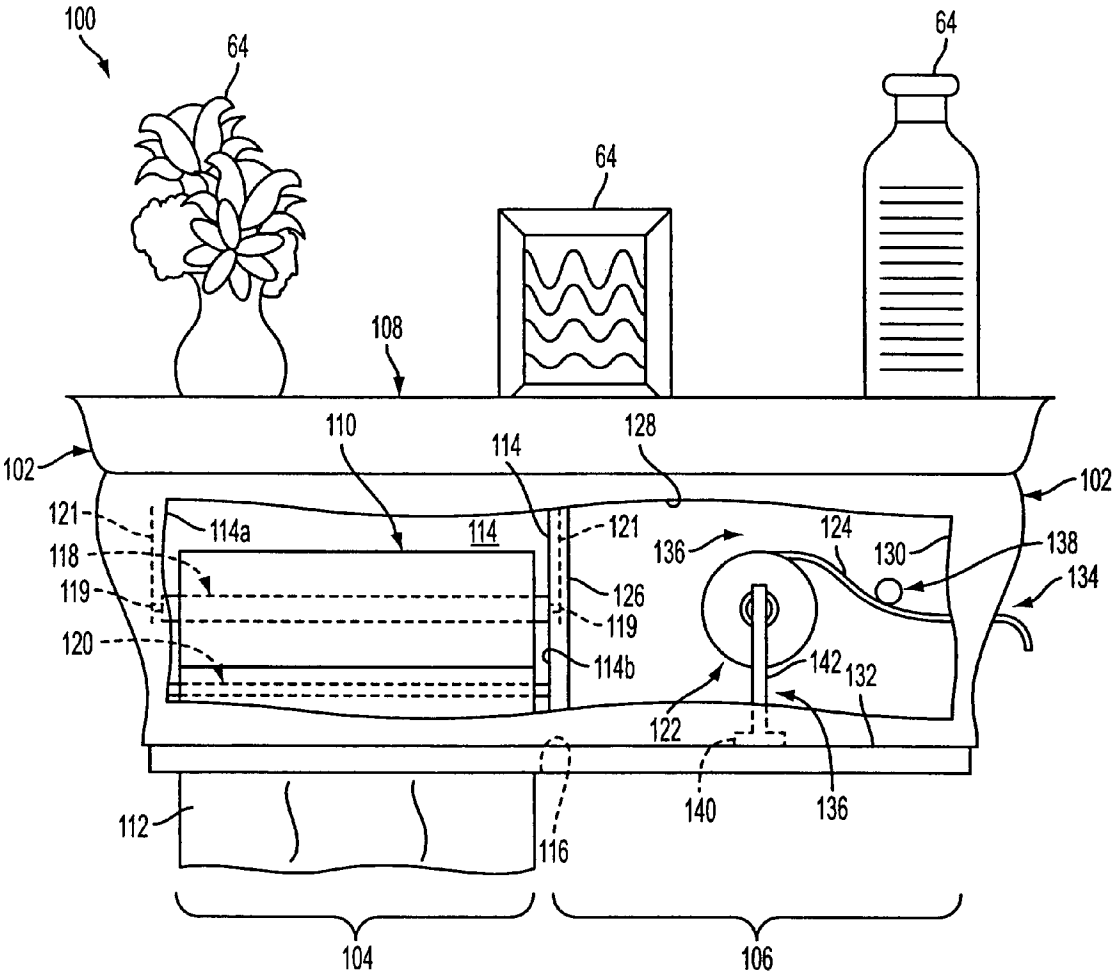
FIG. 5 is a front elevation view of one embodiment of a multi-compartment assembly having a plurality of towel roll compartments, showing a break-away of a portion of the front wall illustrating the interior of such compartments.

In another embodiment illustrated in FIG. 5, the multi-compartment dispensing assembly 100 includes: (a) a housing 102 which includes a bottom dispensing compartment 104 and a side dispensing compartment 106; (b) a door 108 which, in this example, is the same as the door 18 of assembly 10; and (c) a plurality of hanger mounts in the rear wall which, in this example, are the same as the hang mounts 20 and rear wall 22 of assembly 10. In this embodiment, the bottom dispensing compartment 104 holds a towel roll 110 which includes a plurality of perforated towels 112. The bottom dispensing compartment 104 includes: (a) a plurality of retaining walls 114; (b) a bottom wall 116 connected to the retaining walls 114; (c) an axle, rod, tube, pipe or cylindrically shaped or elongated support member 118 which is received by the inner tube (not shown) of the towel roll 110; and (d) an elongated outlet director 120 connected to the retaining walls 114 which directs each towel 112 toward the bottom outlet which is similar in shape and position as the outlet 38 of the assembly 10.

The shaft or roller tube 118 includes a plurality of slot engagers or followers 119, and the retaining walls 114(*a*) and 114(*b*) each define a vertical slot 121 which receives each follower 119. Accordingly, the user can install and remove the towel roll 110 by upwardly sliding the roller tube 118 through the slots 121, removing the roller tube 118 from the compartment 104, inserting the roller tube 118 into the roller tube 118 and downwardly sliding the roller tube 118 through the slots 121. The bottom of each slot 121 functions as a stop which properly positions the towel roll 110 within the bottom dispensing compartment 104.

As illustrated in FIG. 5, the side dispensing compartment 106 holds a towel roll or tissue roll 122 which includes a plurality of perforated sheets 124. The side compartment 106 includes: (a) a plurality of retaining walls 126, 128, 130 and 132; (b) a side outlet 134 defined by retaining wall 130; (c) a roll holding assembly 136 which rotatably holds the tissue roll 122; and (d) an outlet director 138 which directs each tissue sheet 124 toward the side outlet 134.

In one embodiment, the roll holding assembly 136 includes: (a) a connecting wall or mount 140 which is connected to the retaining wall 132; (b) a plurality of arms 142; and (c) a shaft or roller tube (not shown) which is removably connectable to the arms 142. In one example, the roller tube has a plurality of movable parts coupled together through one or more springs, and the size of the roller tube can be increased or decreased to enable users to removably insert tissue rolls 122 into the side dispensing compartment 106.

Figure 6:
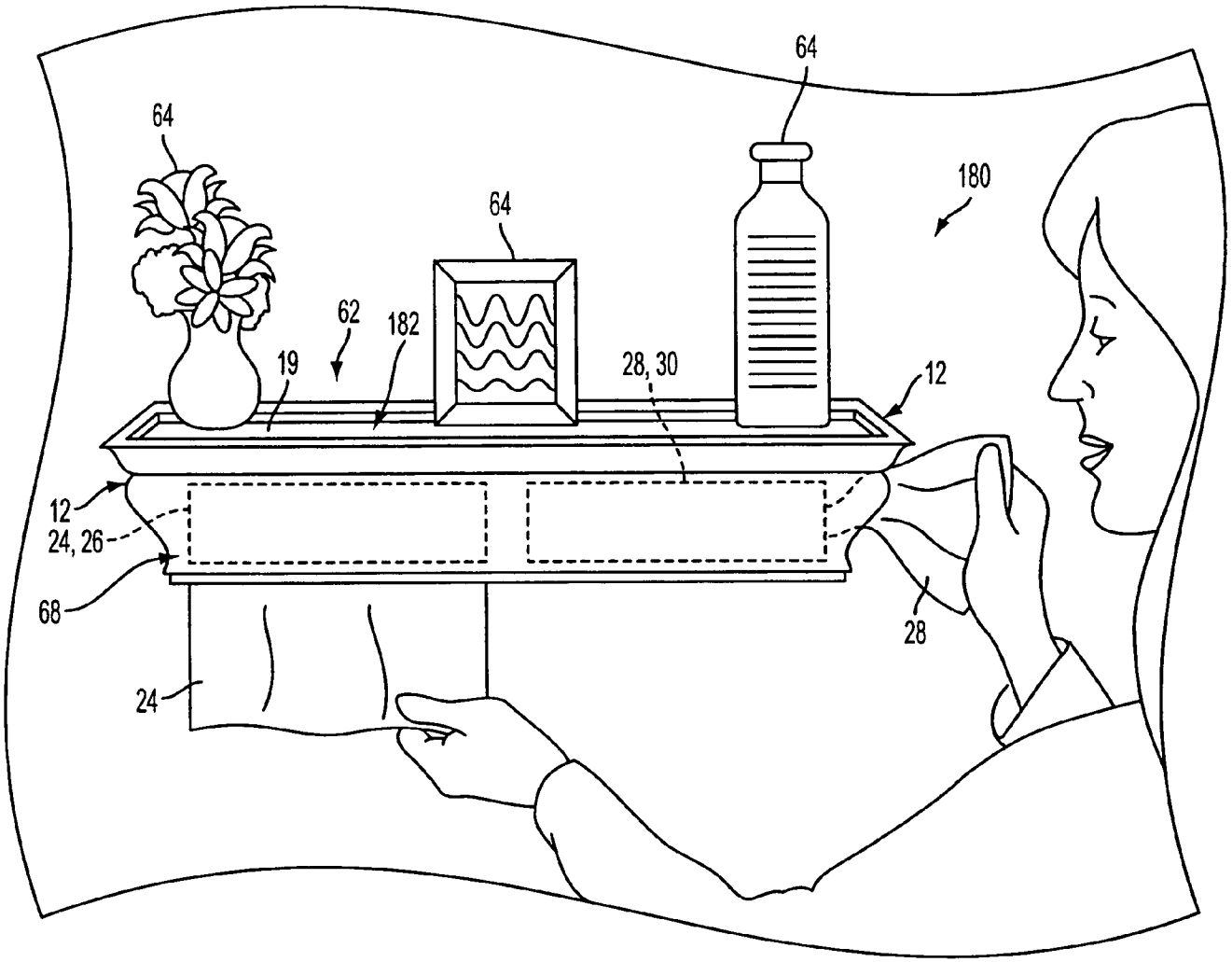
FIG. 6 is a perspective view of one embodiment of the multi-compartment dispensing assembly having a non-movable shelf surface, illustrating an example of a user withdrawing a dry paper towel from the left compartment and a web paper towel from the right compartment.
Figure 7:
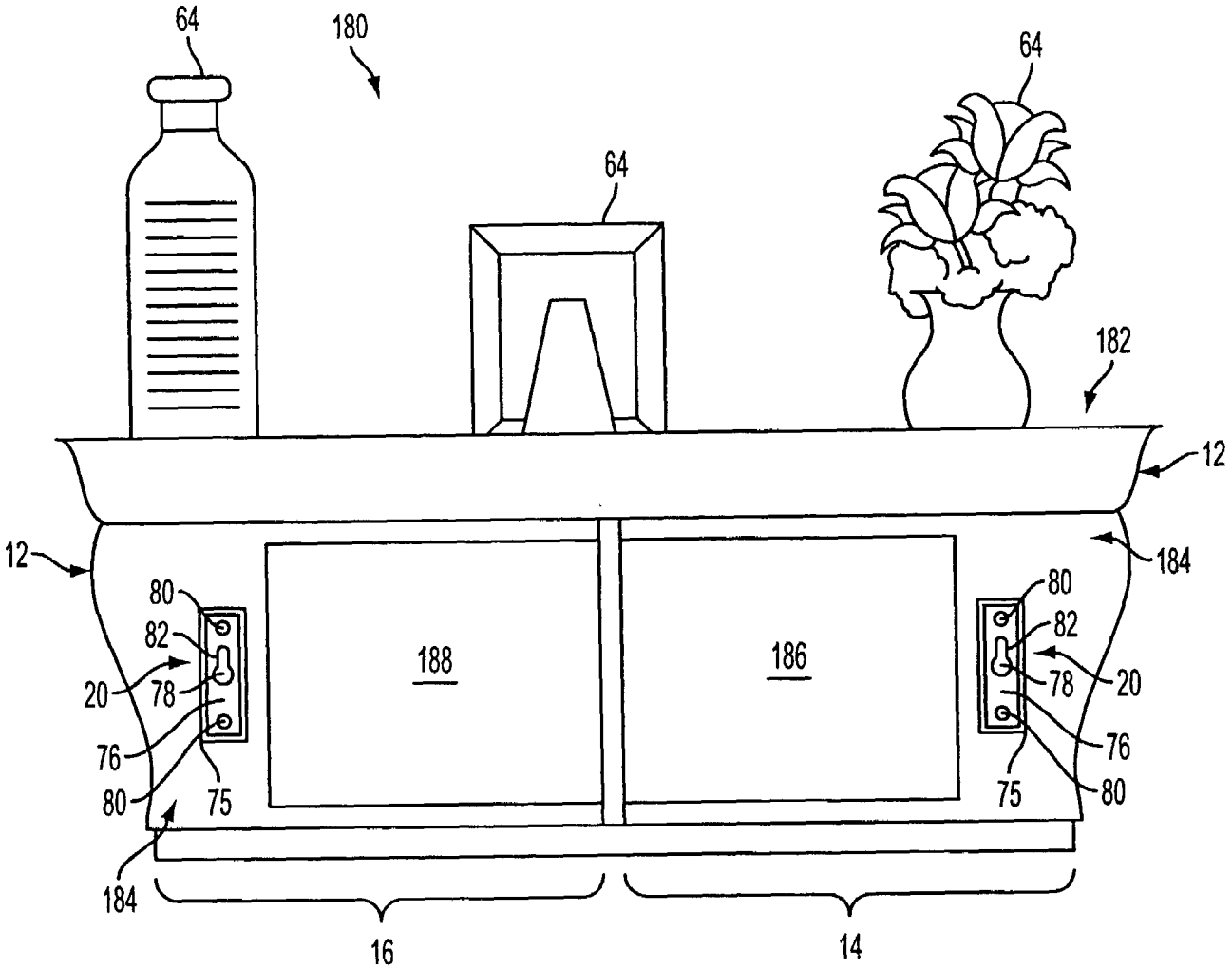
FIG. 7 is a rear elevation view of the assembly of FIG. 6, illustrating the rear access openings and the hang mounts.

In another embodiment illustrated in FIGS. 6 and 7, the towel dispensing assembly 180 includes: (a) a housing 12 as described above with respect to FIGS. 1-5; (b) an upper surface or shelf panel 182 which, unlike door 18, is non-movably or fixedly attached to or integrated with the housing 12; (c) a rear wall 184 which defines a plurality of rear access openings 186 and 188; and (d) a plurality of hang mounts 20 as described above with respect to FIGS. 1-5. To load the towel dispensing assembly 180, the user removes the assembly 180 from the room's wall to gain access to the rear access openings 186 and 188. In operation, the user can insert disposable towels 24 or a disposable towel unit 26 through the access opening 186 to load the bottom dispensing compartment 14. Also, the user can insert disposable towels 28 or a disposable towel unit 30 through the access opening 188 to load the side dispensing compartment 16.

Figure 8:
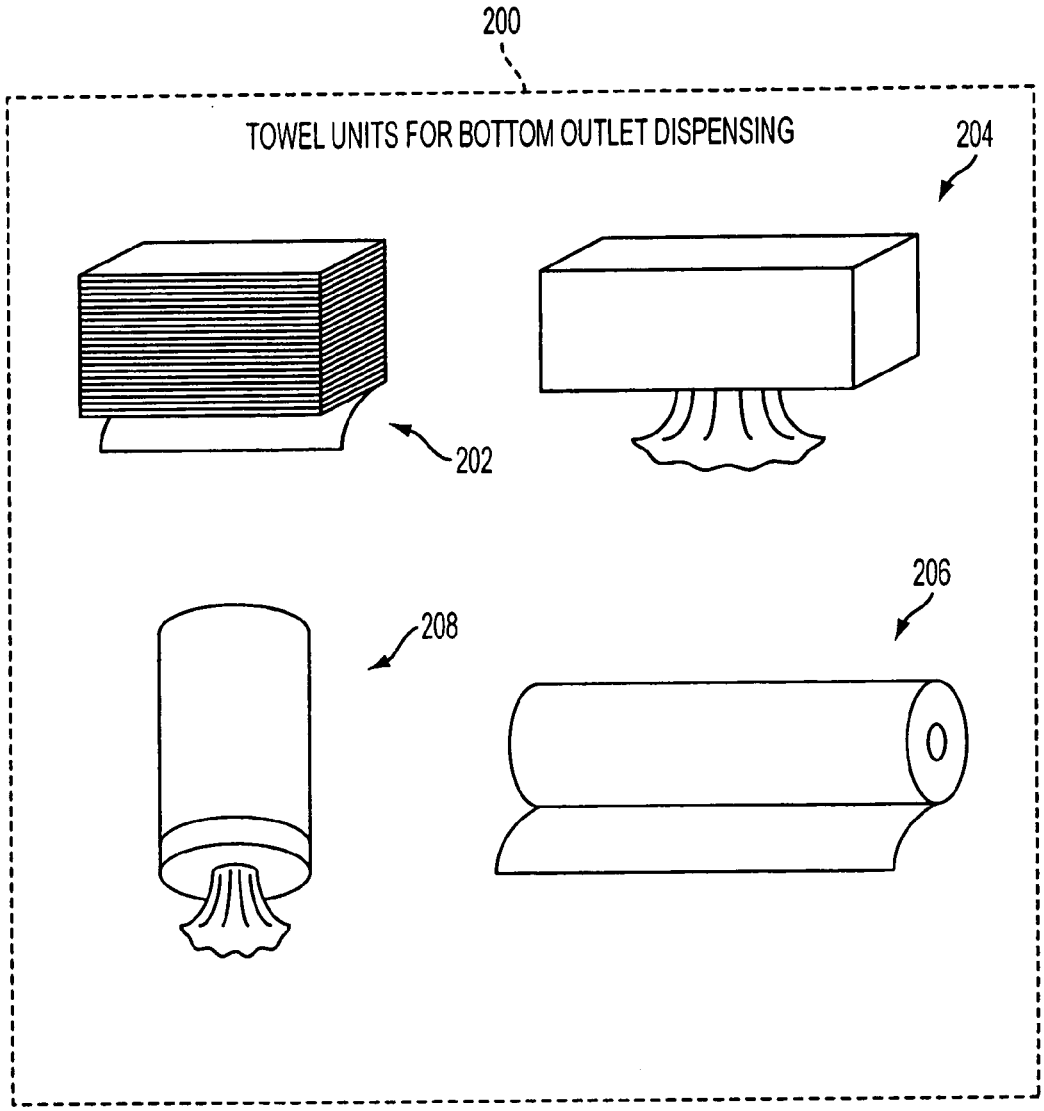
FIG. 8 is a perspective view of different embodiments of towel units which are suitable for bottom outlet dispensing.
Figure 9:
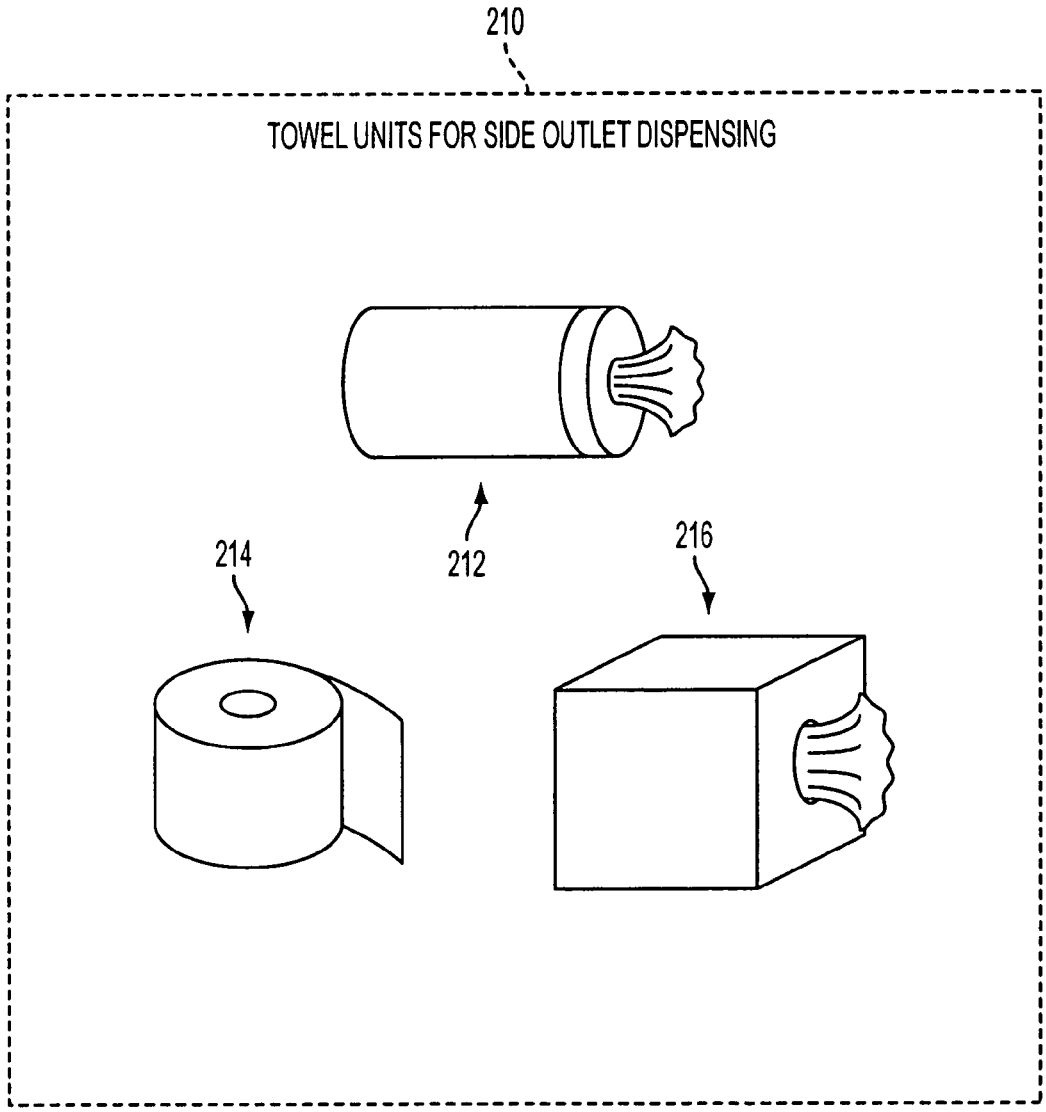
FIG. 9 is a perspective view of different embodiments of towel units which are suitable for side outlet dispensing.

Referring to FIG. 8, a plurality of different types of towel units 200 can be used in the bottom dispensing compartments 14 and 104. For example, these towel units 200 include, without limitation, a unit 202 of foldable or stackable paper towels, a box of tissues 204 positioned upside down, a paper towel roll 206 and a canister of wet wipes 208 positioned upside down. As illustrated in FIG. 9, a plurality of different types of towel units 210 can be used in the side dispensing compartments 16 and 106. For example, these towel units 210 include, without limitation, a canister 212 of wet wipes positioned on its side, a tissue roll 214 positioned with its inner tube along a vertical axis and a tissue box 216 positioned on its side.

II. Single-Compartment Assemblies

Figure 10:
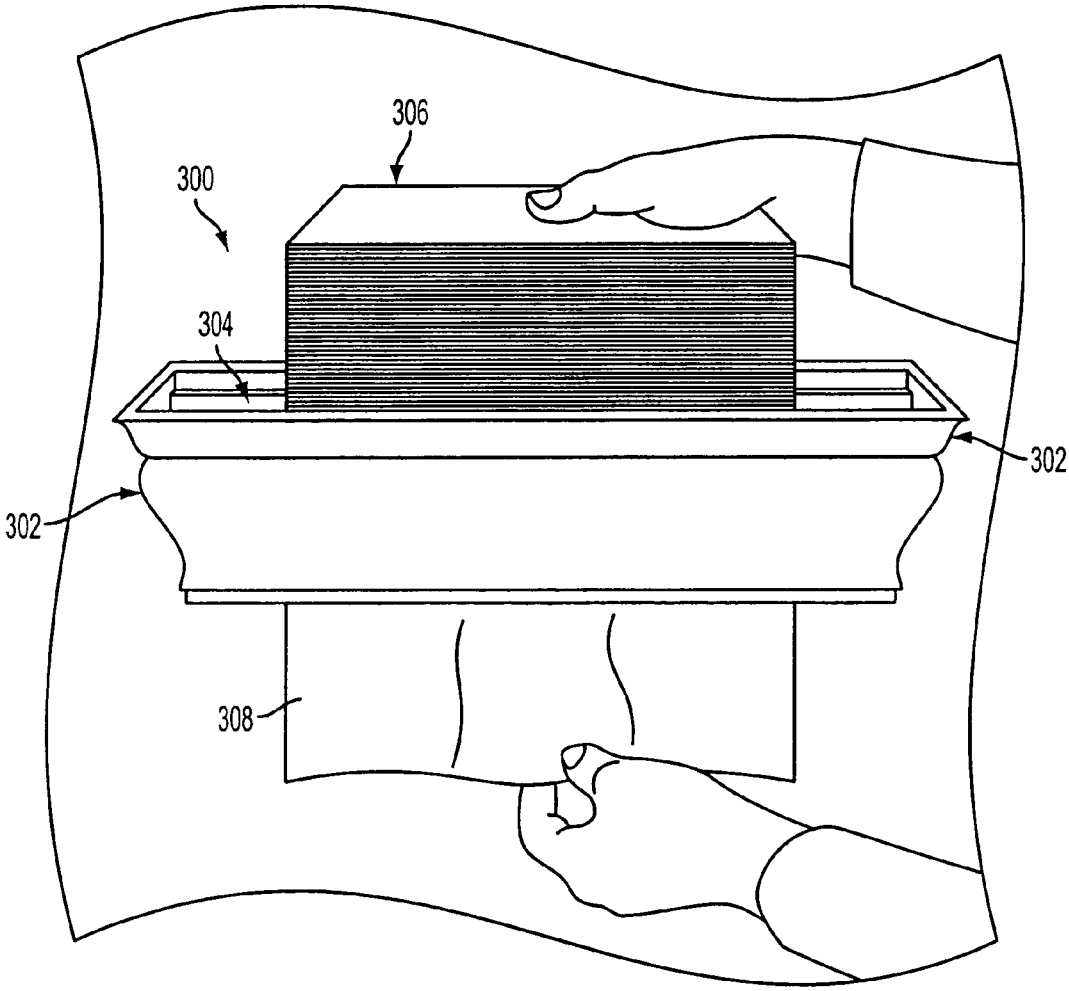
FIG. 10 is a perspective view of one embodiment of a single compartment towel dispensing assembly.

Referring to FIG. 10, in another embodiment, the towel dispensing assembly 300 includes: (a) a housing 302 which includes a single compartment 304; (b) a door (not shown) which, in this example, is similar to the door 18 of assembly 10; and (c) one or more hanger mounts (not shown) which are similar to the hang mounts 20 of assembly 10. In this embodiment, the compartment 304 includes a bottom wall, outlet wall and outlet (not shown) which are similar to the bottom wall 34, outlet wall 36 and outlet 38, respectively, of assembly 10. Accordingly, the user can insert a towel unit 306 into the assembly 300, and users can pull towels 308 from the assembly 300 for use.

Figure 11:
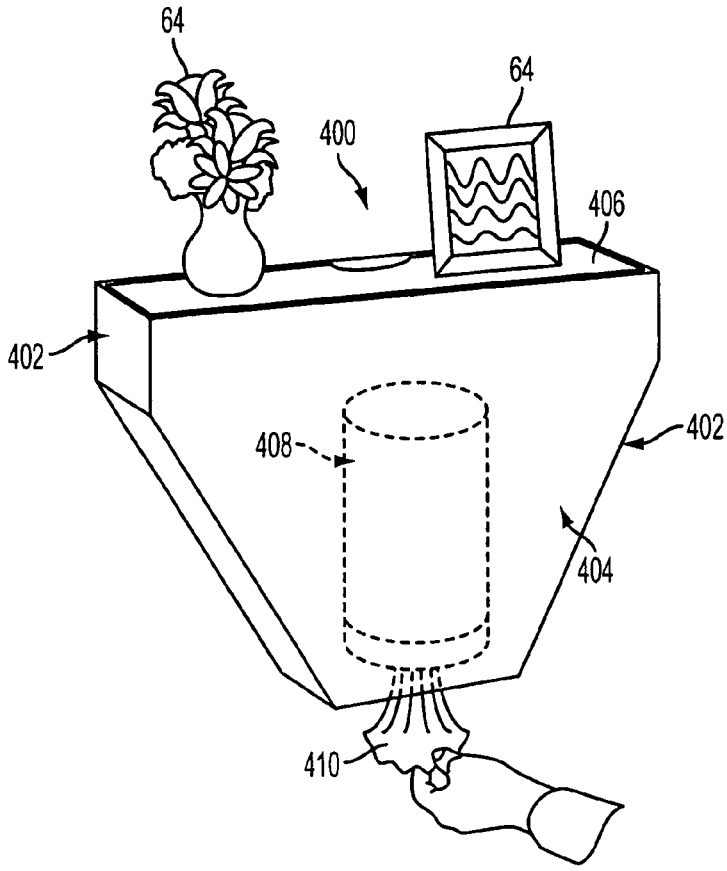
FIG. 11 is a side elevation perspective view of one embodiment of a single compartment wet towel dispensing assembly.
Figure 12:
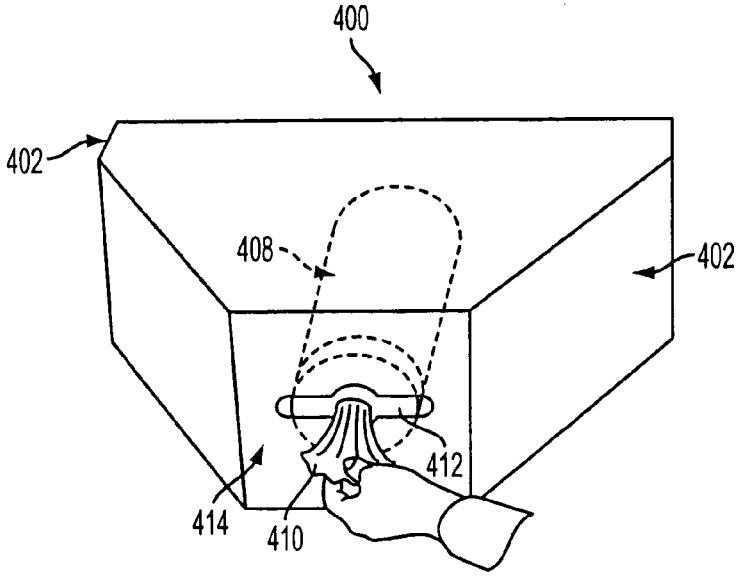
FIG. 12 is a bottom perspective view of the single compartment wet towel dispensing assembly of FIG. 11.

In another embodiment illustrated in FIGS. 11 and 12, the towel dispensing assembly 400 includes: (a) a housing 402 which includes a single towel container or towel canister compartment 404; (b) a door 406 which is similar to the door 18 of assembly 10; and (c) one or more mounts (not shown) which are similar to the mounts 20 of assembly 10. The towel canister compartment 404 is configured to hold one or more towel containers or canisters 408. The canister 408 is positioned upside down to enable moist or wet towel sheets 410 to be pulled through the outlet 412 defined by the bottom wall 414 of the compartment 404. The outlet 412 is similar in configuration to the outlet 38 of assembly 10. In this embodiment, the housing 402 has a partially triangular or trapezoidal shape providing a cross-width which increases from the bottom wall 414 toward the door 406 of the assembly. Accordingly, although the bottom wall 414 has a relatively small width, the door 406 has a relatively large width to provide additional shelf surface for shelving of items.

Figure 13:
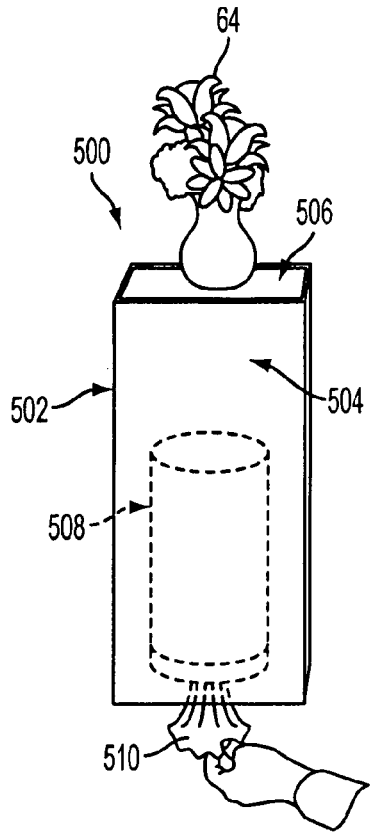
FIG. 13 is a side elevation perspective view of another embodiment of a single compartment wet towel dispensing assembly.
Figure 14:
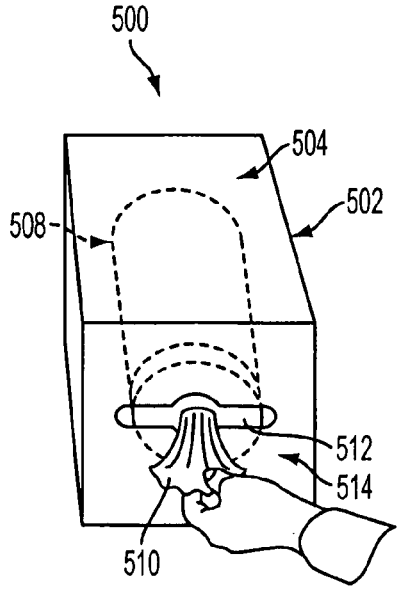
FIG. 14 is a bottom perspective view of the single compartment wet towel dispensing assembly of FIG. 13.

Referring to FIGS. 13 and 14, the assembly 500, in one embodiment, includes: (a) a housing 502 including a single towel container or canister compartment 504; (b) a door 506 which, in this example, has a door grasp member (not shown) which is similar to the door grasp member 70 of assembly 10; and (c) one or more mounts (not shown) which are similar to the mounts 20 of assembly 10. In this example, the housing 502 has a box-like rectangular shape. The canister compartment 504 holds a wet wipe or wet towel canister 508 which includes a plurality of perforated wet towel sheets 510. A user can operate assembly 500 by pulling one of the sheets 510 through the outlet 512 defined by the bottom wall 514. In this example, the outlet 512 is similar in shape to the outlet 38 of assembly 10.

Figure 15:
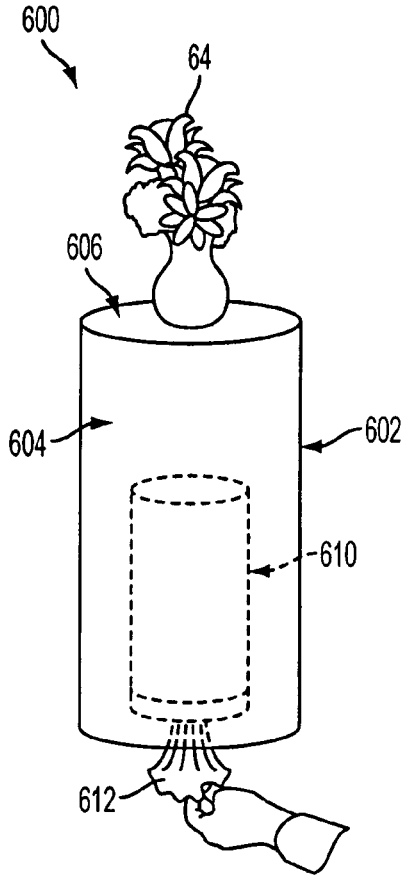
FIG. 15 is a side elevation perspective view of another embodiment of a single compartment wet towel dispensing assembly.
Figure 16:
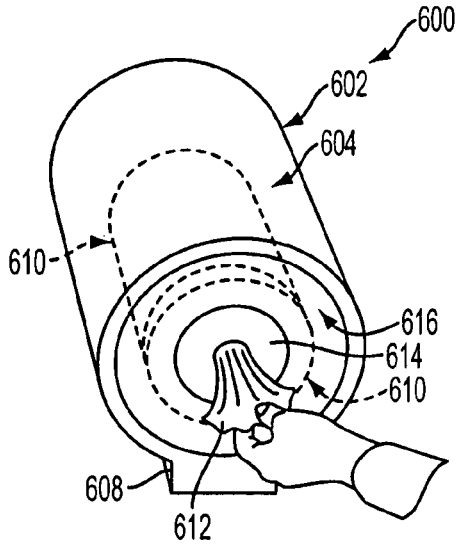
FIG. 16 is a bottom perspective view of the single compartment wet towel dispensing assembly of FIG. 15.

Referring to FIGS. 15 and 16, the assembly 600, in one embodiment, includes: (a) a cylindrical-shaped housing 602 which includes a towel container or towel canister compartment 604; (b) a circular-shaped door 606 which fits within a perimeter recess defined by the housing 602; and (c) one or more mounts (not shown) connected to the mount wall 608 which, in this example, are similar to the mounts 20 and rear wall 22 of the assembly 10. The canister compartment 604 holds a towel canister 610. In use, the user pulls one of the towel sheets 612 through the outlet 614 defined by the bottom wall 616 of the housing 602. In this example, the outlet 614 has a circular shape.

Figure 17:
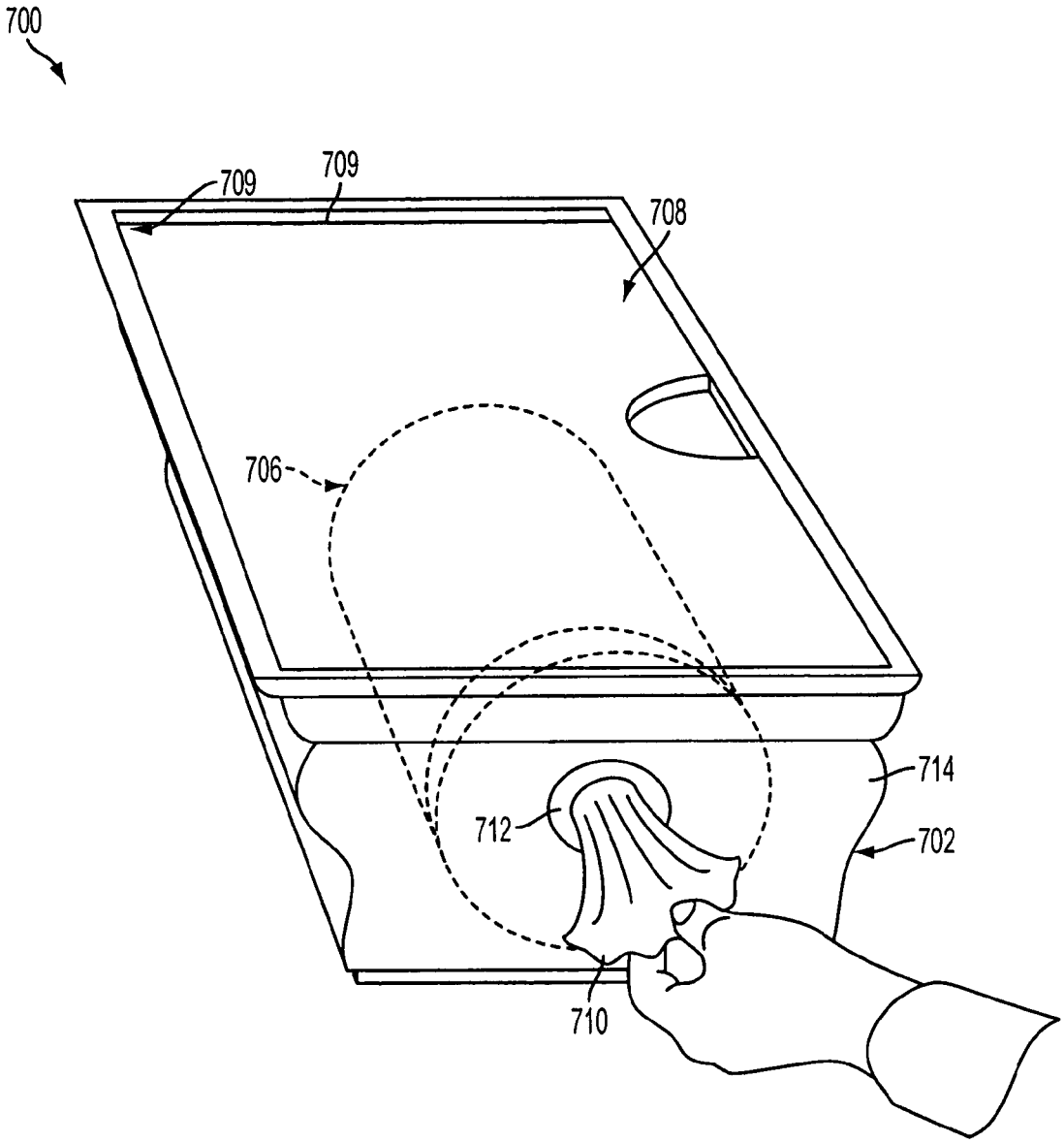
FIG. 17 is a top perspective view of another embodiment of a single compartment wet towel dispensing assembly.

Referring to FIG. 17, the assembly 700, in one embodiment, includes: (a) a housing 702 which includes a canister compartment 704 for holding a canister 706; (b) a door 708 which removably fits within a perimeter recess 709 defined by the housing 702; and (c) a plurality of mounts (not shown) which are similar to the mounts 20 of assembly 10. In this embodiment, the door 708 is similar to the configuration of the door 18 of assembly 10. In operation, the user pulls one of the wet towel sheets 710 through the side outlet 712 defined by the side wall 714 of the housing 702. In this example, the side outlet 712 has a circular configuration.

III. Lockable Multi-Compartment Assemblies

Figure 18:
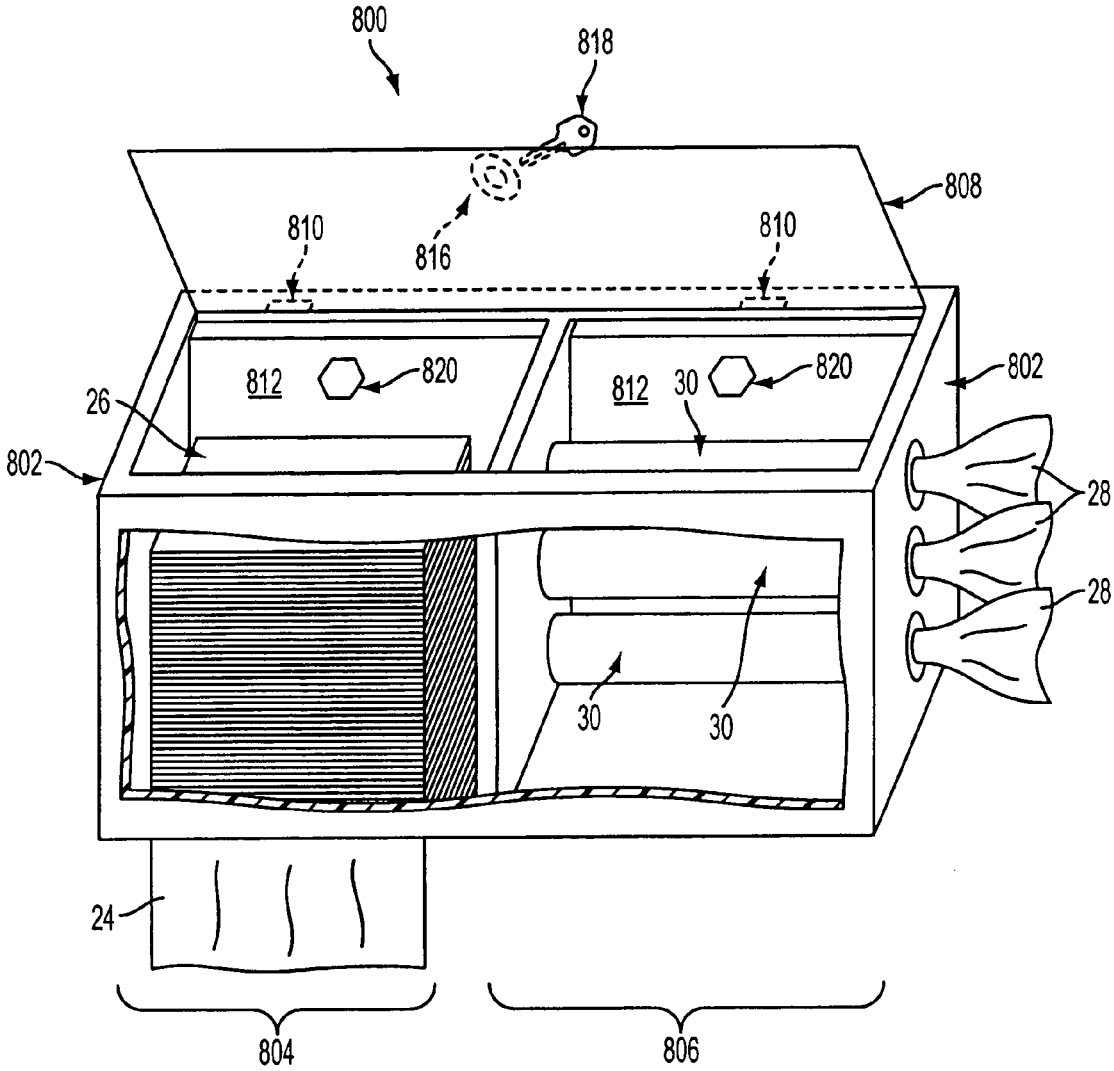
FIG. 18 is a perspective view of one embodiment of a lockable multi compartment towel dispensing assembly having a top door, showing a break-away of a portion of the front wall.

Referring to FIG. 18, the multi-compartment assembly 800, in one embodiment, includes: (a) a housing 802 which includes a bottom dispensing compartment 804 and a side dispensing compartment 806; (b) a lockable door 808 which is connected to the housing 802 through a plurality of connectors or hinges 810; and (c) a plurality of mount walls 812 within the rear wall of the housing 802.

The structure and components of assembly 800 are similar to the structure and components of assembly 10. In the illustrated example, assembly 800 has additional security functionality which is suitable for commercial applications. The door 808 includes a lock 816 which can be opened with a key 818 or any other suitable opener. It should be appreciated that, instead of a lock and key mechanism, the door 808 can include a combination lock, electronically operated lock or any other suitable locking mechanism. In addition, the mount walls 812 define mount openings or holes (not shown). This enables installers to open the door 808 and mount the assembly 800 to the wall of a room using suitable fasteners, such as screws or bolts 820.

Figure 19:
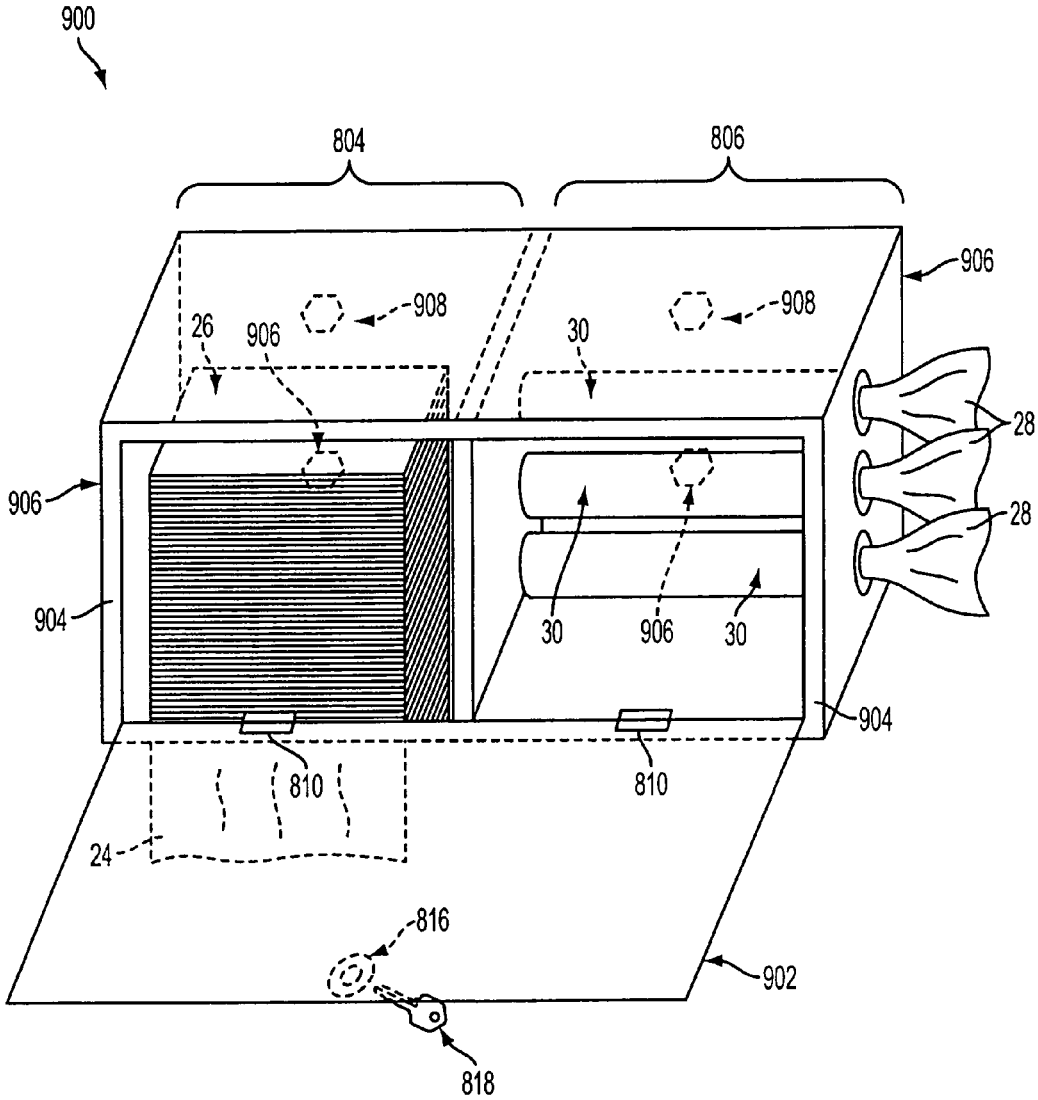
FIG. 19 is a perspective view of one embodiment of a lockable multi compartment towel dispensing assembly having a front door.

Referring to FIG. 19, the multi-component assembly 900, in one embodiment, includes all of the components of assembly 800 except that the lockable door 902 is positioned within or connected to the front wall 904 of the housing 906. Also, the assembly 900 includes lower mount walls 906 in addition to upper mount walls 908. With the lockable door 902 being connected to the front wall 904 of the assembly 900, installers have greater access to the mount holes (not shown) defined by the mount walls 906 and 908.

IV. Mirror Assemblies

Figure 20:
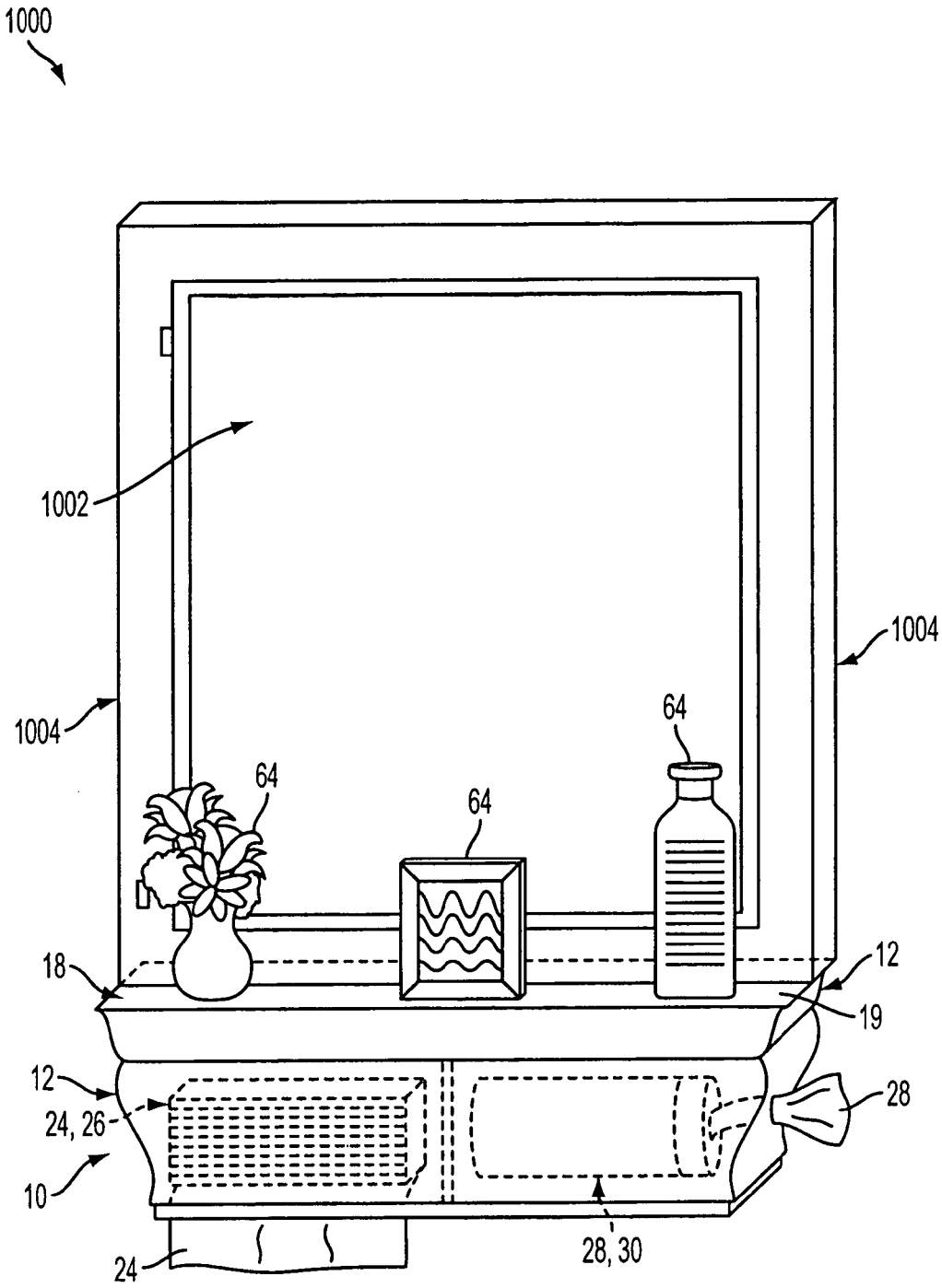
FIG. 20 is a perspective view of one embodiment of a mirror assembly.

Referring now to FIG. 20, the mirror assembly 1000, in one embodiment includes: (a) a mirror 1002; (b) a support structure, support or frame 1004 which supports the mirror 1002; (c) the multi-compartment assembly 10 which is connected to the bottom portion 1006 of the frame 1004; and (d) one or more mounts (not shown) which can be used to connect the frame 1004 to the wall of a room. It should be appreciated that the mirror assembly 1000 can include, instead of assembly 10, any of the assemblies 100, 180, 200, 300, 400, 500, 600, 700, 800 or 900.

Though not illustrated, it should be appreciated that the 10, 100, 180, 200, 300, 400, 500, 600, 700, 800 and 900 can be used to store items within their compartments. In this embodiment, the lower wall of the compartment includes a, interior storage or shelf surface. In one example, one of the compartments is empty, that is, does not contain disposable towels. Accordingly, users can store items, such as cleansing products, toothbrushes, deodorant products, within such compartment.

The assemblies 10, 100, 180, 200, 300, 400, 500, 600, 700, 800 or 900 can be constructed of plastic, wood, metal, a combination thereof or any other suitable material. In one embodiment, the assemblies 100, 180, 200, 300, 400, 500, 600 and 700 are constructed of acrylonitrile butadiene styrene (ABS) or medium density fiberboard (MDF). In one embodiment, the assemblies 800 and 900 are constructed of metal or stainless steel.

In another embodiment, each of the assemblies 10, 100, 180, 200, 300, 400, 500, 600, 700, 800, 900 and 1000 includes one or more electrical or electronic devices. These electrical or electronic devices can include, without limitation, a locking mechanism, a light fixture or a light source, one or more light emitting diodes, a thermometer, a clock, an alarm, a musical player, a computer screen or computer device, a sensor which detects when there is a diminished volume of disposable towels in the assembly or any other suitable electronic, electrical, electromechanical or computer-controlled apparatus. These devices and apparatuses can be powered by battery source or through electrical wires connected to a building power source.

It should be appreciated that any and all of the various components of the assemblies 10, 100, 180, 200, 300, 400, 500, 600, 700, 800, 900 and 1000 can be combined or interchanged thereby constituting additional embodiments of the present invention.

The towel dispensing assembly of the present invention includes one or more towel holding compartments and a shelf surface integrated into the assembly. The shelf surface, carried by the door, enables users to support various shelvable items on the towel dispensing assembly. At the same time, the towel dispensing assembly provides users with access to one or more different types of towels. Accordingly, the towel dispensing assembly provides users with increased storage space, towel access and convenience of use.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. An assembly comprising:

a housing defining at least one compartment configured to hold a volume of a plurality of towels, each one of the towels being configurable to have a length, a width and a thickness, the housing having:

(a) a lower portion having an outlet wall, the outlet wall defining an outlet having an outlet length which is at least as long as the length of each one of the towels, the outlet configured to enable the towels to be removed from the compartment through the outlet at least one at a time, the outlet wall having:

(i) a plurality of side portions, each of the side portions defining one outlet width which is less than the width of each one of the towels, and (ii) a central portion positioned between the side portions, the central portion defining an outlet width which is greater than the outlet width of each one of the side portions, the central portions being sized and configured to facilitate access to one or more of the towels by one or more fingers;

(b) a plurality of retaining walls which are connected to each other so as to define an inner perimeter which surrounds the at least one compartment, each one of the retaining walls having an upper portion, the upper portions of the retaining walls defining a recess having a depth;

at least one mount connected to the housing, the mount being configured to mount the housing to an upstanding support structure; and a door having:

(a) a shelf surface configured to support one or more shelvable items, (b) a perimeter which is less than the inner perimeter defined by the retaining walls, (c) a thickness which is less than the depth of the recess so that the door is configured to be supported by the retaining walls while a portion of each one of the retaining walls extends above the shelf surface, the portions of the retaining walls being configured to apply a force to any of the shelvable items which might move beyond the perimeter of the door, (d) a door grasp wall configured so that, when the door is supported by the retaining walls, the door grasp wall and at least one of the retaining walls collectively define an opening, the opening being:

(i) sized to receive at least part of at least one finger, and (ii) positioned to provide visibility into the compartment, enabling visual information about the volume of the towels to be obtained when the door is covering the compartment.

2. The assembly of claim 1, wherein the lower portion of the housing has a surface area, and the door has a greater surface area.

3. The assembly of claim 1, wherein each one of the towels is disposable and has a folded configuration providing each of said towels with a substantially fiat surface, the outlet providing access to a portion of said substantially flat surface of at least one of said towels.

4. The assembly of claim 1, wherein the housing has a rear portion, the mount being connected to the rear portion of the housing.

5. The assembly of claim 1, which includes an support connectable to the housing and configured to be positioned within the compartment, the support operable to rotatably support a roll of paper towels.

6. The assembly of claim 5 which includes an outlet director connected to the housing and positioned within the compartment, the outlet director operable to direct the paper towels toward the outlet.

7. An assembly comprising:

at least one compartment which defines a space configured to hold at least one container which contains a plurality of flexible disposable articles, the container having an outlet providing access to the flexible disposable articles, the at least one compartment having a plurality of side walls, at least one the side walls defining a side outlet, the compartment and container being sized relative to each other so that, when the container is within the compartment, at least part of the side outlet is aligned with at least part of the outlet of the container, enabling the flexible disposable articles to be removed from the container through the side outlet at least one at a time, and an upper portion having an inner perimeter, the upper portion defining a recess extending along the inner perimeter, the recess having a depth;

at least one mount connected to the at least one compartment, the mount configured to mount the compartment to an upstanding support structures; and a door having:

(a) a shelf surface configured to support one or more shelvable items, (b) a perimeter which is less than the inner perimeter of the upper portion, (c) at least one portion with a thickness which is less than the depth of the recess so that the door is configured to be supported by the retaining walls while part of the upper portion extends above the shelf surface, the part being configured to apply a force to any of the shelvable items which might move beyond the perimeter of the door, and (d) a door grasp member which facilitates moving of the door.

8. The assembly of claim 7, wherein: (a) the container is cylindrical and the outlet of the container is circular having a center; and (b) the side outlet is circular having a center, said centers being positioned substantially along an identical axis.

9. The assembly of claim 7, wherein the door grasp member includes a wall configured so that, when the door is supported by the supper portion, the wall and at least part of the upper portion collectively define an opening, the opening being:

(a) sized to receive at least part of at least one finger, and (b) positioned to provide visibility into the compartment when the door is covering the compartment.

10. The assembly of claim 7, wherein the container includes a container selected from the group consisting of: (a) a cylindrical container containing a plurality of disposable wet towels, (b) a box-shaped container containing a plurality of tissues, and (c) a box-shaped container containing a plurality of the flexible disposable articles.

11. The assembly of claim 7, which includes a support connectable to the compartment and configured to be positioned within the compartment, the support operable to maintain the container at a position in which at least part of the side outlet is aligned with at least part of the outlet of the container.

12. The assembly of claim 7, wherein the side wall having the side outlet includes a side wall selected from the group consisting of: (a) a front side wall, (b) a left side wall, and (c) a right side wall.

13. A mirror assembly comprising:

a mirror;

a frame which supports the mirror; and a housing coupled to the frame, the housing defining at least one compartment configured to hold a volume of a plurality of towels, each one of the towels being configurable to have a length, a width and a thickness, the housing having:

(a) a lower portion having an outlet wall, the outlet wall defining an outlet having an outlet length which is at least as long as the length of each one of the towels, the outlet configured to enable the towels to be removed from the compartment through the outlet at least one at a time, the outlet wall having:

(i) a plurality of side portions, each of the side portions defining one outlet width which is less than the width of each one of the towels, and (ii) a central portion positioned between the side portions, the central portion defining an outlet width which is greater than the outlet width of each one of the side portions, the central portions being sized and configured to facilitate access to one or more of the towels by one or more fingers;

(b) a plurality of retaining walls which are connected to each other so as to define an inner perimeter which surrounds the at least one compartment, each one of the retaining walls having an upper portion, the upper portions of the retaining walls defining a recess having a depth;

(c) at least one mount connected to the housing, the mount being configured to mount the housing to an upstanding support structure; and (d) a door having:

(i) a shelf surface configured to support one or more shelvable items, (ii) a perimeter which is less than the inner perimeter defined by the retaining walls, (iv) a thickness which is less than the depth of the recess so that the door is configured to be supported by the retaining walls while a portion of each one of the retaining walls extends above the shelf surface, the portions of the retaining walls being configured to apply a force to any of the shelvable items which might move beyond the perimeter of the door, (v) a door grasp wall configured so that, when the door is supported by the retaining walls, the door grasp wall and at least one of the retaining walls collectively define an opening, the opening being:

(x) sized to receive at least part of at least one finger, and (y) positioned to provide visibility into the compartment, enabling visual information about the volume of the towels to be obtained when the door is covering the compartment.

14. The mirror assembly of claim 13, wherein the lower portion of the housing has a surface area, and the door has a greater surface area.

15. The mirror assembly of claim 13, wherein each one of the towels is disposable and has a folded configuration providing each one of said towels with a substantially flat surface, the outlet providing access to a portion of said substantially flat surface of at least one of said towels.

16. The mirror assembly of claim 13, wherein the housing has a rear portion, the mount being connected to the rear portion of the housing.

17. The mirror assembly of claim 16, which includes a support connectable to the housing and configured to be positioned within the compartment, the support operable to rotatably support a roll of paper towels.

18. The mirror assembly of claim 17, which includes an outlet director connected to the housing and positioned within the compartment, the outlet director operable to direct the paper towels toward the outlet.

19. An assembly comprising:

a housing defining at least one compartment configured to hold a volume of a plurality of folded disposable towels, each one of the folded disposable towels being configurable to have a length, a width, a thickness and a substantially flat surface, the housing having:

(a) a lower portion having a surface area and an outlet wall, the outlet wall defining an outlet having an outlet length which is at least as long as the length of each one of the folded disposable towels, the outlet providing access to a portion of the substantially flat surface of at least one of the folded disposable towels, the outlet configured to enable the folded disposable towels to be removed from the compartment through the outlet at least one at a time, the outlet wall having:

(i) a plurality of side portions, each of the side portions defining one outlet width which is less than the width of each one of the folded disposable towels, and (ii) a central portion positioned between the side portions, the central portion defining an outlet width which is greater than the outlet width of each one of the side portions, the central portions being sized and configured to facilitate access to one or more of the folded disposable towels by one or more fingers;

(b) a plurality of retaining walls which are connected to each other so as to define an inner perimeter which surrounds the at least one compartment, each one of the retaining walls having an upper portion, the upper portions of the retaining walls defining a recess having a depth;

a plurality of mounts connected to the housing, the mounts being configured to mount the housing to an upstanding support structure, each one of the mounts defining a space sized to receive a head of a fastener; and a door having:

(a) a shelf surface configured to support one or more shelvable items, the shelf surface having an area which is greater than the surface area of the lower portion of the housing, (b) a perimeter which is less than the inner perimeter defined by the retaining walls, (c) a thickness which is less than the depth of the recess, (d) a door grasp wall configured so that, when the door is supported by the retaining walls, the door grasp wall and at least one of the retaining walls collectively define an opening, the opening being:

(i) sized to receive at least part of at least one finger, and (ii) positioned to provide visibility into the compartment, enabling visual information about the volume of the folded disposable towels to be obtained when the door is covering the compartment.

20. The assembly of claim 19, wherein a portion of each one of the retaining walls is positioned within a different plane which extends upward from the lower portion of the housing, a plurality of said planes being angled away from each other.

21. The assembly of claim 19, wherein the thickness of the door is less than the depth of the recess so that the door is configured to be supported by the retaining walls while a portion of each one of the retaining walls extends above the shelf surface, the portions of the retaining walls being configured to apply a force to any of the shelvable items which might move beyond the perimeter of the door.

* * * * *